United States Patent [19]

Morris et al.

[11] Patent Number: 5,027,440

[45] Date of Patent: Jul. 2, 1991

[54] SOCK WITH STORAGE POCKET

[76] Inventors: John A. Morris, 1692 Wallace St.; Gene E. Stout, 1976 Northeast Ave., #146, both of Vineland, N.J. 08360

[21] Appl. No.: 430,752

[22] Filed: Nov. 2, 1989

[51] Int. Cl.[5] ..... A41B 11/00

[52] U.S. Cl. ..... 2/239; 2/253

[58] Field of Search ..... 2/239, 247, 251, 252, 2/253, 248, 249, 250; 66/173, 178 R

[56] References Cited

U.S. PATENT DOCUMENTS

| | | | |
|---|---|---|---|
| 1,117,591 | 11/1914 | Morningstar | 2/239 |
| 1,128,941 | 2/1915 | Brown | 2/239 |
| 1,574,077 | 2/1926 | Frantz | 2/252 |
| 2,383,217 | 8/1945 | Schaffer | 02/253 |
| 2,814,807 | 12/1957 | Dollar | 2/239 |
| 2,890,461 | 6/1959 | Hartman et al. | 2/239 |
| 4,005,494 | 2/1977 | Burn | 2/239 |
| 4,451,935 | 6/1984 | Henschel | 2/253 X |
| 4,631,755 | 12/1986 | Zingg et al. | 2/239 |

FOREIGN PATENT DOCUMENTS

| | | | |
|---|---|---|---|
| 216648 | 11/1909 | Fed. Rep. of Germany | 2/253 |
| 391916 | 11/1908 | France | 2/239 |
| 2344238 | 3/1976 | France | 2/239 |
| 2363292 | 9/1976 | France | 2/239 |
| 2364626 | 4/1978 | France | 2/239 |
| 25167 | of 1914 | United Kingdom | 2/239 |

OTHER PUBLICATIONS

"Trappers", Package Label, Soxet, Inc., Youngstown, Ohio.

*Primary Examiner*—Werner H. Schroeder
*Assistant Examiner*—Sara M. Current
*Attorney, Agent, or Firm*—Seidel, Gonda, Lavorgna & Monaco

[57] ABSTRACT

A sock includes pockets for storing small items. A first pocket is disposed on the calf portion of a sock, defining a cavity and an opening, and having a fold adjacent to the opening to releasably retain items in the cavity. A second pocket is disposed between the first pocket and the sock, defining the second cavity and an opening. In a preferred embodiment, the two pockets are formed by attaching a folded pouch to the calf portion of a sock.

4 Claims, 2 Drawing Sheets

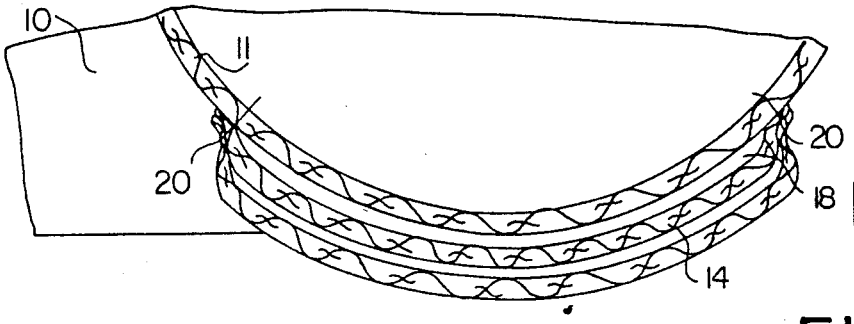
FIG. 4
FIG. 5A
FIG. 5D
FIG. 5C
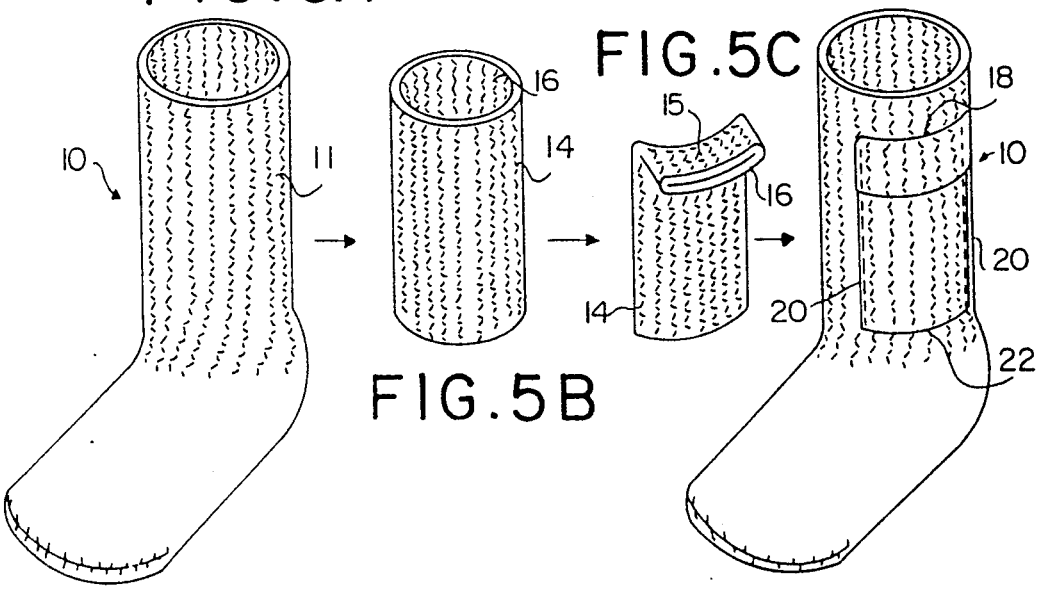
FIG. 5B
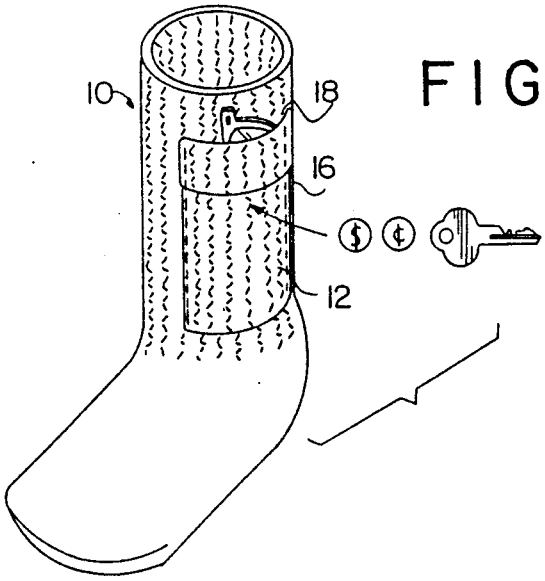
FIG. 6

SOCK WITH STORAGE POCKET

FIELD OF THE INVENTION

The present invention relates to a sock having a pocket for storage of small items.

BACKGROUND OF THE INVENTION

When jogging or exercising, people tend to wear athletic clothing, such as shorts and tee-shirts, which are generally not provided with practical pockets. When jogging through a park, for example, a person would want to carry his house keys with him, and in a public gym, a person may be hesitant to leave keys or valuables in a locker. Even if shorts are provided with pockets, the normal motions of a person jogging or exercising are likely to cause keys, coins, or a wallet to fall out of the pocket and become lost.

There may also be many other times a sock with a pocket may be convenient, and the invention is not limited to any particular use. For example, the sock of the present invention could be used under ordinary clothing to conceal valuables, much as one would wear a money belt.

It is an object of the present invention to circumvent these problems, by providing means for storing small items securely in a sock.

Another object of the present invention is to provide a sock having pocket means which may be easily manufactured.

Another object of the invention is to provide a secure yet inexpensive pocket means that may be used with any type of garment.

Other objects will appear hereinafter.

SUMMARY OF THE INVENTION

The present invention is a sock of typical construction, with a foot portion and a calf portion. Attached to the exterior of the calf portion is a pocket means generally comprising a pouch open at one end. At the open end, a portion of the pouch is folded over so that the opening is disposed toward the middle of the pouch. The pouch is attached to the exterior of the calf portion of the sock, for example by seams disposed around the side and bottom edges of the pouch, so that the side edges of the folded portion are securely attached to the calf portion of the sock. The pouch defines a first pocket, and a second pocket is created between the pouch and the exterior of the sock. Access to the second pocket is provided near the top of the pouch.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 4 is a cross-sectional view through line 4—4 of FIG. 1.

FIGS. 5*a*—*d* are a series of views demonstrating one way the sock of the present invention may be manufactured.

FIG. 6 shows a sock incorporating the present invention, being used to carry small items.

DETAILED DESCRIPTION OF THE INVENTION

Figure 1:
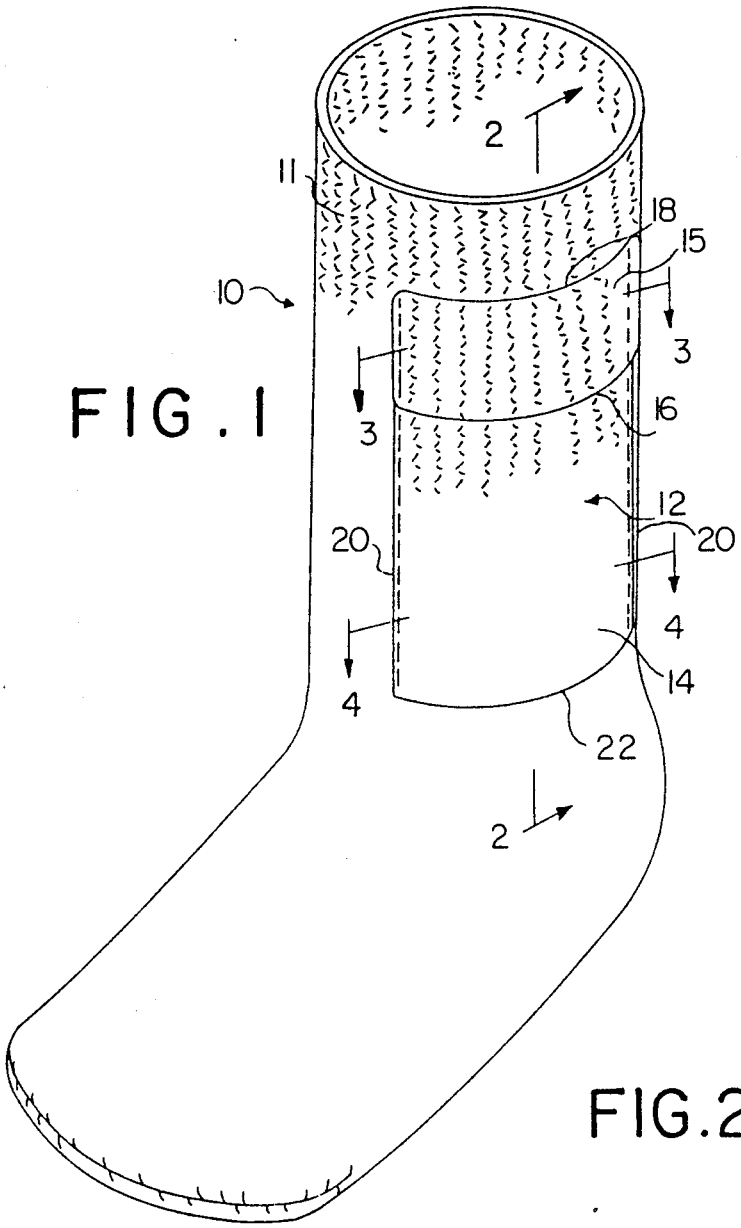
FIG. 1 shows a sock incorporating the present invention.
Figure 2:
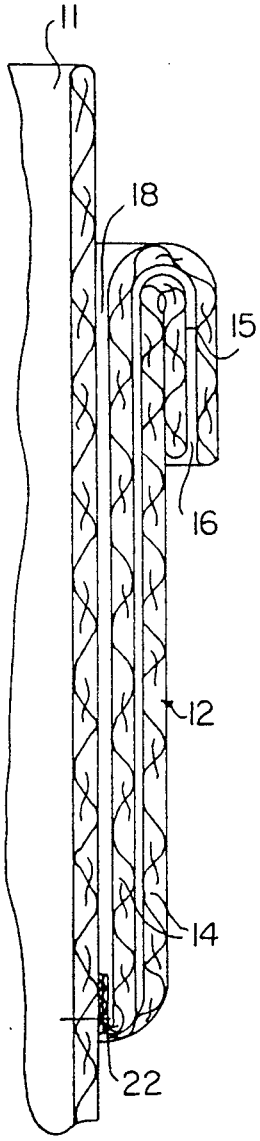
FIG. 2 is a cross-sectional view through line 2—2 of FIG. 1.

FIG. 1 shows an athletic sock 10, in accordance with the present invention. The lower portion of the sock covers the foot, and the upper portion is of any desired length common in socks to cover the ankle and at least a portion of the calf. Towards the upper portion of the sock is pocket means 12. Pocket means 12 is preferably, although not necessarily, formed from a tube made of an elasticized knit material as is customarily used for the calf portion of athletic socks. Of course, the tube may be any suitable material without departing from the invention. The tube is preferably flattened to form a pouch 14, which defines a cavity of such a size as to hold desired items such as coins or keys, and includes an open end with an opening 16. The portion of pouch 14 near opening 16 is folded downward on the rest of pouch 14, thus placing the opening 16 facing toward the middle of the pouch 14. This folded portion, marked 15 in FIG. 2, will help prevent an item stored in pouch 14 from falling out should a physical shock push the item upward within the pouch. In addition to the pocket formed by the interior of pouch 14, a second pocket 18 is formed in the space between pouch 14 and the exterior of the sock 12, as can be clearly seen in the side view of FIG. 2.

Figure 3:
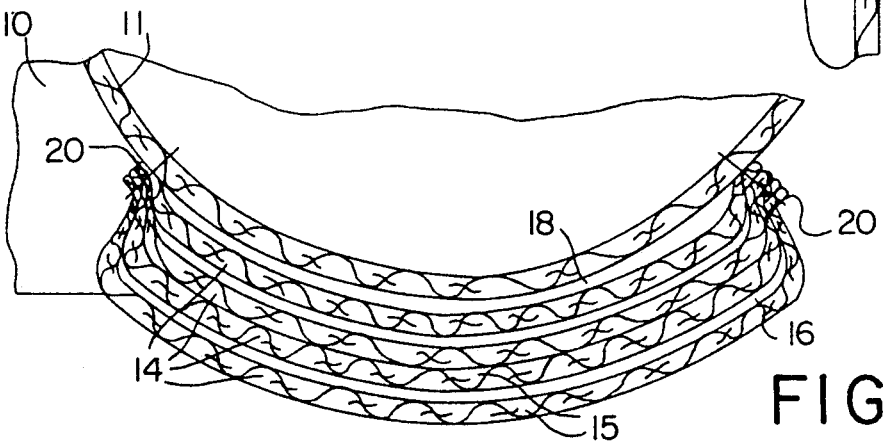
FIG. 3 is a cross-sectional view through line 3—3 of FIG. 1.

Pouch 14 is preferably attached to the calf portion 11 of sock 10 by means of side seams 20 and bottom seam 22, although other suitable attachment means could be used. Side seams 20 are disposed along the side edges of pouch 14, and also serve to tack down the folded portion 15 of pouch 14 so that opening 16 opens downward when the sock 10 is worn. Thus an item, such as a key or coin, is inserted into the interior cavity of pouch 14 by pushing it upward into opening 16, through folded portion 15 and then downward into the main cavity of pouch 14. FIG. 3 shows the arrangement of pouch 14 in the area of folded portion 15. Seams 20 secure the folded portion 15 against the sock. Bottom seam 22 attaches the bottom portion of pouch 14 to the calf portion 11 of sock 10, thus forming the bottom of both pouch 14 and pocket 18. Seam 22 is preferably sewn with a thread having elastic properties, so that when the calf portion 11 is stretched by a wearer's leg, the area around bottom seam 22 will not bind.

Pocket 18 is slightly larger than the pocket of pouch 14, and may be of a size to accept items such as sunglasses or a wallet. Although pocket 18 does not include a top flap to prevent items from falling out, when the top portion of sock 10 is stretched over a calf, the resilience of the elastic knit of the pouch 14 and the calf portion of the sock will cause an item in either pocket to be pressed against the leg, further providing security against an item falling out.

The sock of the present invention has the advantages of providing a relatively spacious storage area for small items, as well as means for securing items within pouch 14. Further, the sock of the present invention has the advantage of simple manufacture, and therefore low cost. The pouch 14 is preferably, but need not be, manufactured from the same type of tubular knit material commonly used for the calf portion of socks, so that no unusual manufacturing equipment is necessary. No extra fastening means, such as buttons or snaps, are required.

FIGS. 5*a—d* show one sequence of steps by which the sock of the present invention may be manufactured. FIG. 5*a* shows a sock 10 of typical construction. This sock may be of any type, either contoured to the shape of a foot as shown, or a tube sock. FIG. 5*b* shows a tube of material to be formed into pouch 14, with opening 16. The tube of material is preferably made of the same elastic knit material as is typically used in the calf portion of athletic socks. The tube of material has at least one opening 16, to allow access into its interior. For ease of manufacture, the material may also have a bottom opening due to the tubular knitting process. However, any bottom opening will ultimately be closed by bottom seam 22 when the resulting pouch 14 is attached to the sock 10.

In FIG. 5*c*, the tube is generally flattened to form pouch 14, and a portion (for example, one inch) near the opening 16 is folded downward against the rest of pouch 14 to form folded portion 15. In FIG. 5*d* the pouch 14 with folded portion 15 is attached around its sides and bottom periphery to the calf portion of sock 10. The attachment is preferably made by side seams 20 and bottom seam 22. Side seams 20 secure the side edges of the pouch 14 to the calf portion of the sock 10, and further tack down the folded portion 15 so that opening 16 is directed downward. Bottom seam 22 attaches the bottom of pouch 14 to the calf portion 11 of sock 10, and may also form the bottom closure of pouch 14 if pouch 14 is constructed from a tubular piece of material having two open ends. Side seams 20 and bottom seam 22 serve as the side and bottom edges of pocket 18, formed in the space between pouch 14 and the exterior of the calf portion 11 of sock 10.

FIG. 6 shows how pocket 18 is adapted to hold larger items, such as sunglasses, and how small items may be stored in either pocket 18 or in pouch 14.

In addition to use on socks, the pocket means 12 of the present invention may conceivably be used on a variety of garments, such as wrist bands, shorts, shirts, or hats, wherein a secure but inexpensive pocket means is desired for carrying small items.

The present invention may be embodied in other specific forms without departing from the spirit or essential attributes thereof and, accordingly, reference should be made to the appended claims, rather than to the foregoing specification, as indicating the scope of the invention.

We claimed:

1. A sock, comprising:

a first portion, adapted to surround a foot, and a second portion, adapted to receive the lower leg of a wearer; and pocket means, including a tube having first and second openings, the tube being flattened and folded so that the first opening is facing generally toward the middle of the tube, the tube being attached to the second portion of the sock around a portion of the perimeter of the tube, the edges of the folded portion of the tube being attached to the exterior of the sock, the second opening of the tube being closed to form a first pocket within the tube, the space between the tube and the exterior of the sock defining a second pocket.

2. A socket as in claim 2, wherein the tube is made of an elastic knit material.

3. A socket as in claim 2, wherein the tube is attached to the exterior of the sock by means including an elastic seam.

4. A method of making a sock having pocket means, comprising the steps of:

providing a sock adapted to surround a foot and receive the lower leg of a wearer;

providing a tube having first and second openings;

folding a portion of the tube adjacent the first opening so that the first opening is facing generally toward the middle of the tube; and attaching the folded tube to the exterior of the sock along a portion of the periphery of the folded tube, including securing the side edges of the folded portion to the exterior of the sock and closing the second opening of the tube, thereby forming a first pocket within the tube and a second pocket between the tube and the exterior of the sock, the second pocket defining a cavity and an opening adjacent to the folded portion of the tube.

* * * * *